US009555276B2

(12) United States Patent
Kim et al.

(10) Patent No.: US 9,555,276 B2
(45) Date of Patent: Jan. 31, 2017

(54) GAIT REHABILITATION APPARATUS HAVING LATERAL ENTRY MECHANISM AND LATERAL ENTRY METHOD USING THE SAME

(71) Applicant: Korea Institute Of Science and Technology, Seoul (KR)

(72) Inventors: Seung-Jong Kim, Seoul (KR); Chang Hwan Kim, Seoul (KR); Jong Min Lee, Gunpo-si (KR); Chan Yul Jung, Bucheon-si (KR); Hyeong-jin Jeon, Seoul (KR); Jun Ho Choi, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 485 days.

(21) Appl. No.: 14/091,701

(22) Filed: Nov. 27, 2013

(65) Prior Publication Data

US 2014/0276266 A1 Sep. 18, 2014

(30) Foreign Application Priority Data

Mar. 13, 2013 (KR) ..... 10-2013-0026895

(51) Int. Cl.
*A61H 3/00* (2006.01)
*A61G 7/10* (2006.01)
(Continued)

(52) U.S. Cl.
CPC ..... *A63B 21/00181* (2013.01); *A61H 3/008* (2013.01); *A63B 22/0235* (2013.01);
(Continued)

(58) Field of Classification Search
CPC ..... A61H 1/0237; A61H 1/0229; A61H 3/00; A61H 3/006; A61H 3/007; A61H 3/008; A61H 2203/0487; A61G 7/1015; A61G 7/1017; A61G 7/1025; A63B 21/00181
See application file for complete search history.

(56) References Cited

U.S. PATENT DOCUMENTS 4,907,571 A * 3/1990 Futakami ..... A61H 3/008 482/69
6,666,831 B1 * 12/2003 Edgerton ..... A61H 1/0237 600/587
(Continued)

FOREIGN PATENT DOCUMENTS

JP 7-21028 U 4/1996
JP 2011-200991 A 10/2011
(Continued)

OTHER PUBLICATIONS

"Wearable Clothing Reality Robot Robot 2010." Technology Powerhouse Korea, Korea Industrial Technology Foundation for Cross-Media and Culture (KIMAC), published May 18, 2010. Accessed Jun. 18, 2014: http://www.itstv.net/info/view.asp?code=376&dataldx=8750 (5 pages, in Korean, with English machine translation).

*Primary Examiner* — Valerie L Woodward
(74) *Attorney, Agent, or Firm* — NSIP Law

(57) ABSTRACT

Disclosed herein is a gait rehabilitation apparatus including a first frame having a bottom surface which is movable at predetermined speed; a second frame extending upwards from a tip of the first frame; a load support unit which is mounted to an upper end of the second frame and is rotatable about a rotation axis thereof; a connection string, one end of which is connected to the load support unit, and the other end of which is connected to an upper body of a rehabilitant; a safety bar which is connected to the second frame and is rotatable so as to be tilted upwards; and a gait assistance link member which has a structure able to be tilted upwards, and is connected to each leg of the rehabilitant entering onto the first frame to assist rehabilitation training of the rehabilitant through mechanical movement of the gait assistance link member.

12 Claims, 5 Drawing Sheets

(51) Int. Cl.

| | |
|---|---|
| ***A63B 22/02*** | (2006.01) |
| ***A63B 21/00*** | (2006.01) |
| ***A63B 69/00*** | (2006.01) |
| ***A63B 24/00*** | (2006.01) |
| *A63B 22/00* | (2006.01) |
| *A63B 71/00* | (2006.01) |

(52) U.S. Cl.
CPC ..... *A63B 24/0087* (2013.01); *A63B 69/0064* (2013.01); *A61G 7/1015* (2013.01); *A61G 7/1017* (2013.01); *A61G 7/1025* (2013.01); *A61G 7/1044* (2013.01); *A63B 2022/0094* (2013.01); *A63B 2024/0093* (2013.01); *A63B 2071/0018* (2013.01)

(56) References Cited

U.S. PATENT DOCUMENTS

| | | | | |
|---|---|---|---|---|
| 7,041,069 | B2 * | 5/2006 | West | A61H 1/0237 601/35 |
| 8,460,162 | B2 | 6/2013 | Park et al. | |
| 2002/0022554 | A1 * | 2/2002 | Borsheim | A63B 22/02 482/54 |
| 2005/0101448 | A1 * | 5/2005 | He | A61H 1/0237 482/54 |
| 2005/0250624 | A1 * | 11/2005 | Yu | A61H 3/008 482/69 |
| 2011/0294624 | A1 * | 12/2011 | Burnfield | A61H 1/0214 482/7 |
| 2012/0090090 | A1 * | 4/2012 | Aabakken | A61G 7/1044 5/87.1 |
| 2012/0110731 | A1 * | 5/2012 | Hand | A61G 7/1015 5/87.1 |
| 2014/0087922 | A1 * | 3/2014 | Bayerlein | A63B 22/0235 482/54 |

FOREIGN PATENT DOCUMENTS

| | | | |
|---|---|---|---|
| KR | 10-2009-0096828 | A | 9/2009 |
| KR | 10-2009-0104261 | A | 10/2009 |
| KR | 10-2010-0044360 | A | 4/2010 |
| KR | 10-0976180 | B1 | 8/2010 |
| KR | 10-2011-0060486 | A | 6/2011 |
| KR | 10-2012-0105085 | A | 9/2012 |
| KR | 10-2012-0129651 | A | 11/2012 |

* cited by examiner

GAIT REHABILITATION APPARATUS HAVING LATERAL ENTRY MECHANISM AND LATERAL ENTRY METHOD USING THE SAME

CROSS-REFERENCE TO RELATED APPLICATION

This application claims priority to Korean Patent Application No. 10-2013-0026895 filed on Mar. 13, 2013, the disclosure of which is incorporated herein by reference in its entirety.

BACKGROUND

Field

Exemplary embodiments of the present invention relate to a gait rehabilitation apparatus having a lateral entry mechanism and a lateral entry method using the same, and more particularly, to a gait rehabilitation apparatus having a lateral entry mechanism and a lateral entry method using the same, capable of achieving an improvement in space efficiency by allowing a rehabilitant to laterally enter the gait rehabilitation apparatus when the rehabilitant conducts rehabilitation training using the gait rehabilitation apparatus.

Description of Related Art

Gait rehabilitation robots are apparatuses which assist paraplegic patients or the elderly and patients having weak physical strength in conducting gait training without undergoing large loads on their legs. Such gait rehabilitation robots are classified into a robot which allows a patient to conduct the gait training or live in the state of directly wearing the robot, and a robot which is mounted to a treadmill to allow a patient to repeatedly conduct the gait training.

As conventional gait rehabilitation robots, treadmill type gait rehabilitation robots are disclosed in Korean Patent Laid-open Publication No. 10-2009-0104261 published on Oct. 6, 2009 and Korean Patent Laid-open Publication No. 10-2009-0096828 published on Sep. 15, 2009.

In a conventional gait rehabilitation robot, a rehabilitant should move near the treadmill by a wheelchair prior to conducting rehabilitation training on the treadmill. Accordingly, it is required to secure a large space in the rear of the treadmill such that the wheelchair may be moved in order for the rehabilitant to enter the treadmill. In addition, in the treadmill of the rear entry type, an inclined surface or the like is further required in order for the rehabilitant to enter the treadmill, and an extra space is required in the rear of the treadmill in order for the rehabilitant to climb the inclined surface. Moreover, when a therapist pushes the wheelchair on which the rehabilitant is seated, so as to allow the wheelchair to enter the treadmill, there is also a risk of being likely to cause a safety accident.

Thus, in order to solve the foregoing problems, there is a need to develop a method which may prevent the occurrence of a safety accident while using a small space during entry of the rehabilitant into the gait rehabilitation apparatus.

SUMMARY

An object of the present invention is to provide a gait rehabilitation apparatus having a lateral entry mechanism and a lateral entry method using the same, capable of achieving improvements in space efficiency and safety by allowing a rehabilitant to laterally enter the gait rehabilitation apparatus.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a gait rehabilitation apparatus having a lateral entry mechanism, includes a first frame having a bottom surface which is movable at predetermined speed; a second frame extending upwards from a tip of the first frame; a load support unit which is mounted to an upper end of the second frame, and is rotatable about a rotation axis thereof and is linearly drivable; a connection string, one end of which is connected to the first frame, and the other end of which is connected to an upper body of a rehabilitant; a safety bar which is connected to the second frame and is rotatable so as to be tilted upwards; and a gait assistance link member which is connected to the second frame and has a structure able to be tilted upwards, the gait assistance link member being connected to each leg of the rehabilitant which enters onto the first frame to assist rehabilitation training of the rehabilitant.

In the gait rehabilitation apparatus, the load support unit may include a drive portion and a control portion, which allow the load support unit to be adjustable in a rotation, linear, and upward/downward directions depending on a series of training courses suitable for the rehabilitant.

The load support unit may include a first connection rod which extends downwards, and a second connection rod which is formed integrally with the first connection rod and extends in both directions from a tip of the first connection rod.

The first connection rod may be in the form of a rigid body or a string.

The gait rehabilitation apparatus may further include a sensor to detect a connection state between the connection string and the rehabilitant and a state in which the rehabilitant is seated on the first frame.

The safety bar and the gait assistance link member may be located inward of a rotation radius of the load support unit in a state of being tilted upwards.

In accordance with another aspect of the present invention, including a first frame having a bottom surface which is movable at predetermined speed, a second frame extending upwards from a tip of the first frame, a load support unit which is mounted to an upper end of the second frame and is rotatable about a rotation axis thereof, a connection string, one end of which is connected to the load support unit, and the other end of which is connected to an upper body of a rehabilitant, a safety bar which is connected to the second frame and is rotatable so as to be tilted upwards, and a gait assistance link member which is connected to each leg of the rehabilitant which enters onto the first frame to assist rehabilitation training of the rehabilitant through mechanical movement of the gait assistance link member, the lateral entry method includes connecting the upper body of the rehabilitant, which is placed at a side of the first frame, to the connection string; and seating the rehabilitant on the first frame by rotating the load support unit.

The lateral entry method using a gait rehabilitation apparatus may further include upwardly tilting the safety bar and the gait assistance link member, prior to connecting the upper body of the rehabilitant to the connection string.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1A:
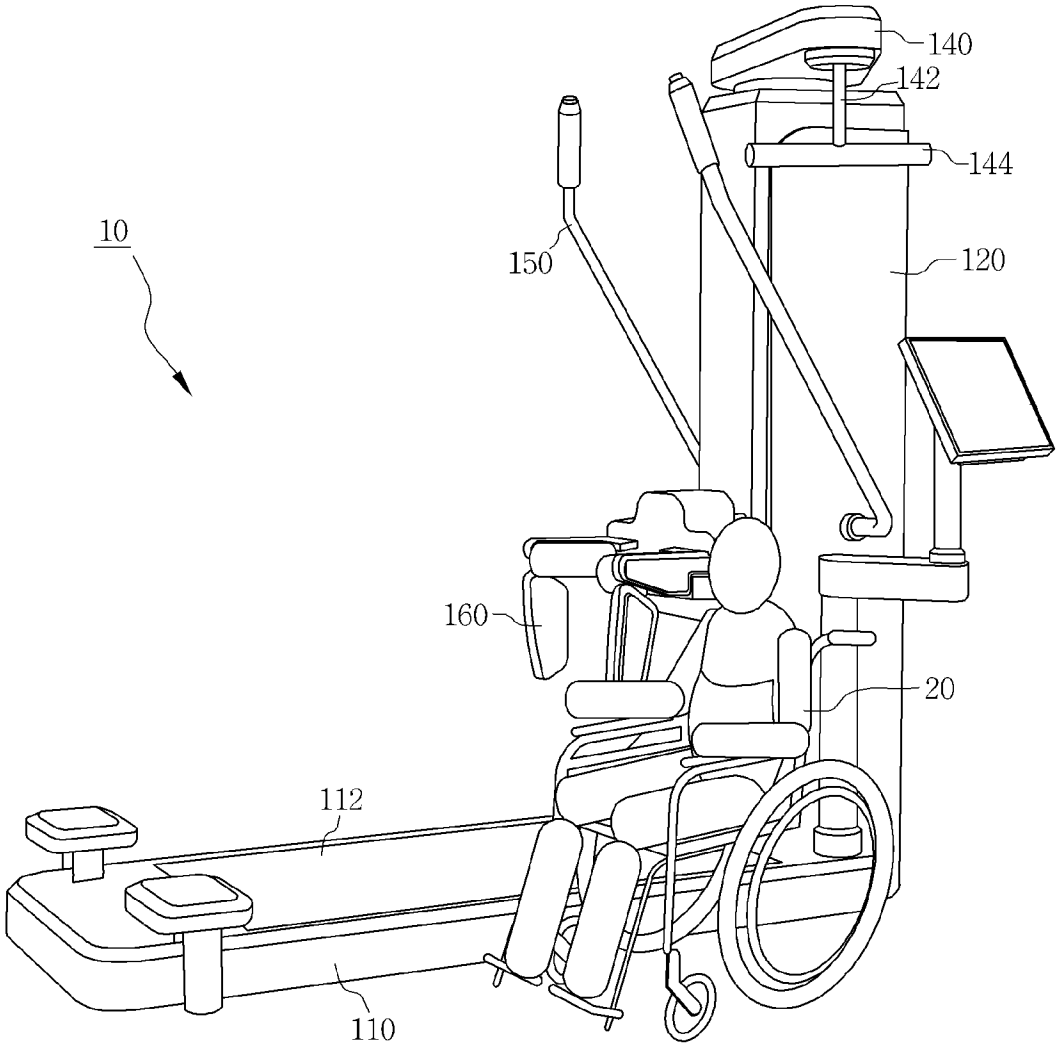
FIGS. 1A to 1D are views illustrating a gait rehabilitation apparatus having a lateral entry mechanism according to an embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention. The drawings are not necessarily to scale and in some instances, proportions may have been exaggerated in order to clearly illustrate features of the embodiments.

Hereinafter, a gait rehabilitation apparatus having a lateral entry mechanism and a lateral entry method using the same according to illustrative embodiments of the present invention will be described in detail with reference to the accompanying drawings.

FIGS. 1A to 1D are views illustrating a gait rehabilitation apparatus having a lateral entry mechanism according to an embodiment of the present invention.

Referring to FIGS. 1A to 1D, a gait rehabilitation apparatus 10 according to an embodiment of the present invention includes a first frame 110, a second frame 120, connection strings 130, a load support unit 140, safety bars 150, and gait assistance link members 160.

The first frame 110 has a bottom surface 112 which is movable at predetermined speed, and provides a region to conduct gait training while feet of a rehabilitant 20 come into contact with the bottom surface 112.

The second frame 120 extends upwards from a tip of the first frame 110, and is connected with the load support unit 140, the safety bars 150, and the gait assistance link members 160.

Each of the connection strings 130 is connected, at one end thereof, to the load support unit 140 while being connected, at the other end thereof, to an upper body of the rehabilitant 20. The connection string 130 may be adjusted in length depending on the body size of the rehabilitant 20. When the upper body of the rehabilitant 20 is connected to the connection string 130, a load of the rehabilitant 20 is transferred through the connection string 130 to the load support unit 140.

The load support unit 140 is mounted to an upper end of the second frame 120, and is rotatable about a rotation axis thereof. Accordingly, the load support unit 140 rotates after the upper body of the rehabilitant 20 is connected to the connection string 130, the body of the rehabilitant 20 may move together. Consequently, since the gait rehabilitation apparatus 10 according to the embodiment of the present invention allows the rehabilitant 20 to enter from the side thereof by only a simple configuration, a space required for the entry of the rehabilitant may be significantly decreased. In addition, since the rehabilitant 20 enters the gait rehabilitation apparatus 10 by rotating the load support unit 140, a risk of a safety accident, which may be caused during movement of the rehabilitant 20, is notably reduced.

In the embodiment of the present invention, the load support unit 140 may include a rotation drive portion (not shown), and a control portion (not shown) to perform rotational drive speed and angle control required for lateral entry and gait training.

In addition, the load support unit 140 may include a first connection rod 142 which extends downwards, and a second connection rod 144 which is formed integrally with the first connection rod 142 and extends in both directions from a tip of the first connection rod 142. In a case where the load support unit 140 includes the first and second connection rods 142 and 144, the connection string 130 may hang on or be fixed to the second connection rod 144. Therefore, work to connect the connection string 130 with the load support unit 140 may be further easily performed. In the embodiment of the present invention, the first connection rod 142 may be adjusted in length. To this end, by providing a separate drive portion, the first connection rod 142 may extend and contract depending on the drive of the drive portion. In a case having this configuration, the length of the first connection rod 142 may be adjusted in real time by driving the drive portion depending on vertical movement of the rehabilitant 20 also during rehabilitation training.

Each of the safety bars 150 is rotatable so as to be tilted upwards, and is maintained in a state parallel with the first frame 110 so that the rehabilitant holds the safety bar with the hand during the rehabilitation training. Herein, the safety bar 150 may be located inward of a rotation radius of the load support unit 140 in a state of being tilted upwards. Thus, in a case where the rehabilitant 20 connected to the connection string 130 enters the gait rehabilitation apparatus 10, the rehabilitant 20 does not interfere with the safety bar 150 even when the load support unit 140 rotates. Therefore, the movement of the rehabilitant 20 is not obstructed.

Alternatively, the safety bar 150 may be rotated manually or by the drive of a motor (not shown).

Each of the gait assistance link members 160 may be connected to the second frame 120 through a four-bar linkage mechanism, and is connected to each leg of the rehabilitant 20 which enters onto the first frame 110. The rehabilitant may conduct the gait training depending on mechanical movement of the gait assistance link member 160 in a state of being pressed against the gait assistance link member 160 by an associated leg connection member 162. In the embodiment of the present invention, the gait assistance link member 160 as well as the safety bar 150 may be tilted upwards and downwards, and be located inward of the rotation radius of the load support unit 140.

The gait rehabilitation apparatus 10 according to the embodiment of the present invention may further include a control portion (not shown) to control moving speed of the bottom surface 112 of the first frame 110, positions of the load support unit 140 and the safety bar 150, and movement of the gait assistance link member 160.

The control portion may adjust the moving speed of the bottom surface 112 of the first frame 110 depending on training intensity of the rehabilitant 20 to be conducted, and also adjust the movement of the gait assistance link member 160 corresponding to the moving speed of the bottom surface 112. Hence, the control portion serves to assist the rehabilitant 20 in training a natural gait pattern at a given position.

In addition, the control portion allows the rehabilitant 20 to safely enter (or advance toward) the gait rehabilitation apparatus 10 by controlling the rotation speed and a stop position of the load support unit 140. Furthermore, the control portion serves to assist the rehabilitant 20 in training a natural gait pattern by driving the load support unit 140 in a horizontal and vertical direction depending on displacement of center of gravity of the rehabilitant 20. Moreover, the control portion may drive the motor so that the safety bar 150 is tilted upwards before the rehabilitant 20 enters the gait rehabilitation apparatus 10 by the load support unit 140. On the other hand, the control portion may drive the motor so that the upward-tilted safety bar 150 rotates again to be parallel with the first frame 110 after the rehabilitant 20 enters the gait rehabilitation apparatus 10 by the load support unit 140.

In the embodiment of the present invention, the gait rehabilitation apparatus 10 may further include a sensor (not shown) to detect a connection state between the connection string 130 and the rehabilitant 20 and a state in which the rehabilitant 20 is seated on the first frame 110. Information detected by the sensor is transferred to the control portion to be used for position control of the load support unit 140 and the safety bar 150.

Figure 2:
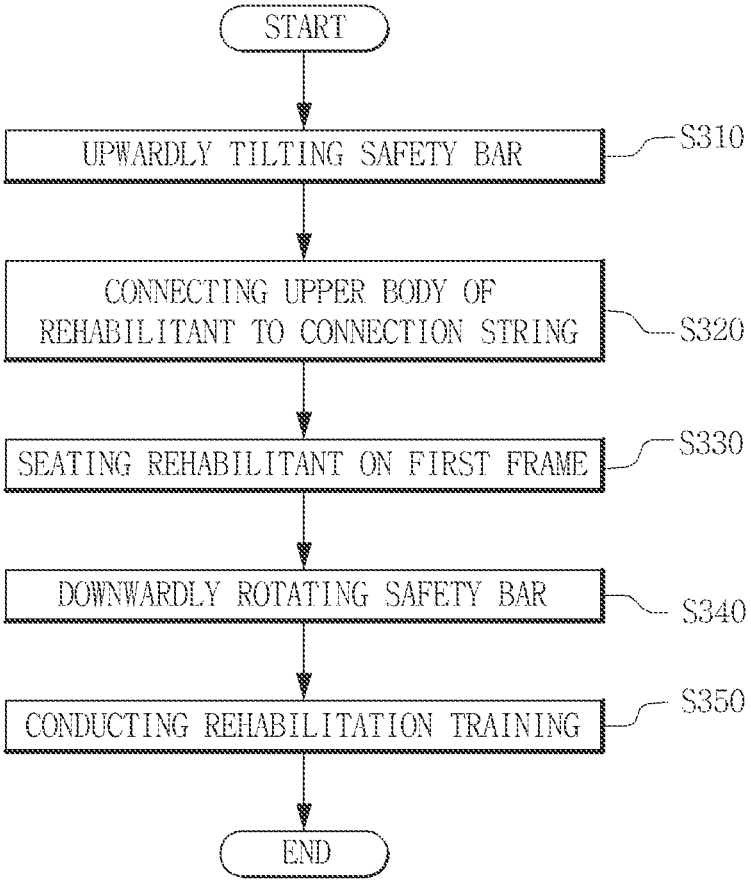
FIG. 2 is a flowchart illustrating a lateral entry method using a gait rehabilitation apparatus according to an embodiment of the present invention.

FIG. 2 is a flowchart illustrating a lateral entry method using a gait rehabilitation apparatus according to an embodiment of the present invention.

Referring to FIG. 2, first, the safety bar 140 and the gait assistance link member 160 are tilted upwards prior to connecting the upper body of the rehabilitant 20 to the connection string 130 (S310). As described above, the safety bar 150 may be rotated manually or by the drive of the motor. In addition, the gait assistance link member 160 may rotate about a connection portion, as the rotation axis, with the second frame 120 by a predetermined angle in an upward and downward direction.

Figure 1B:
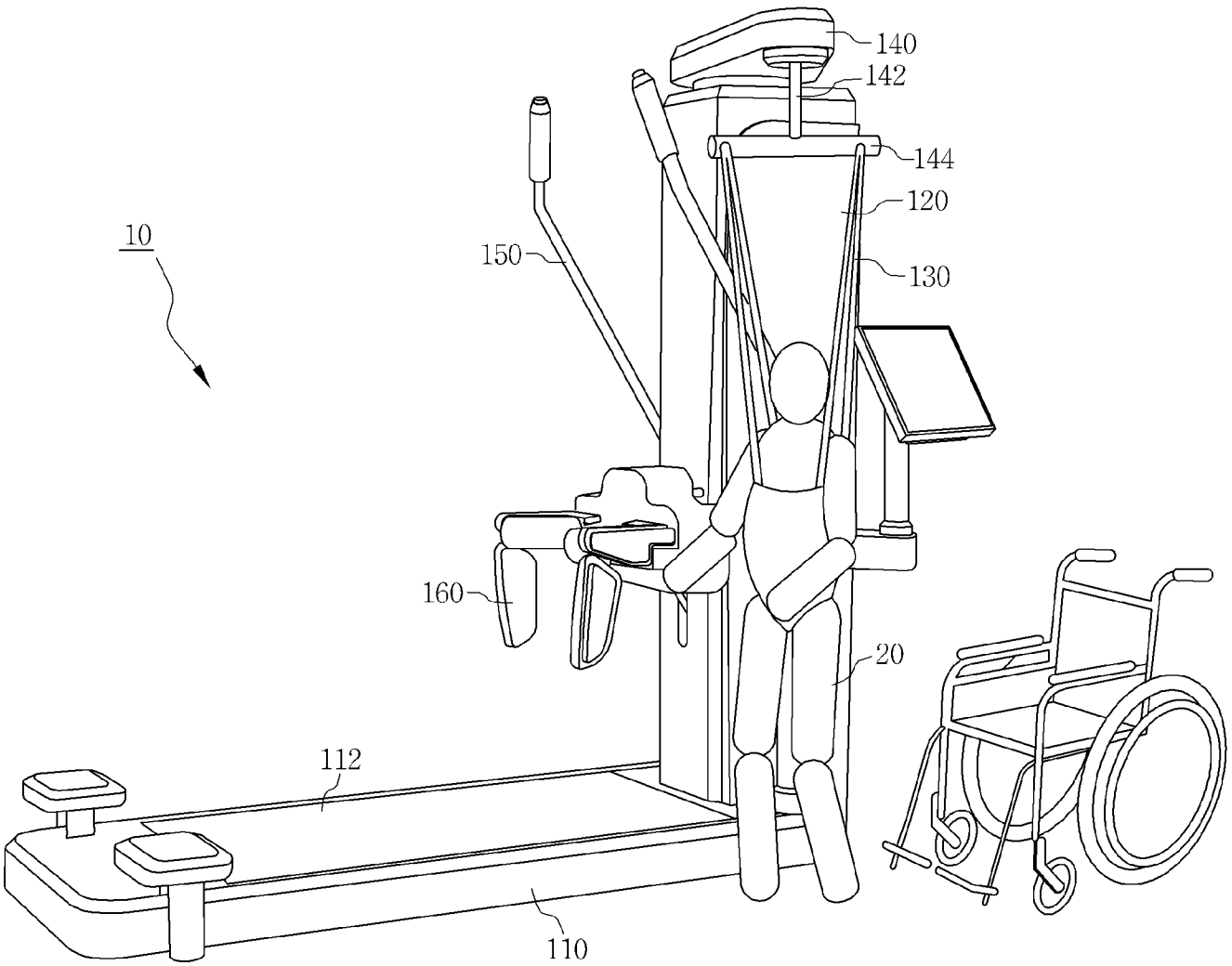

Next, the upper body of the rehabilitant 20, which is placed at the side of the first frame 110, is connected to the connection string 130 (S320). This state is shown in FIG. 1B, and the length of the connection string 130 may be adjusted depending on the body size of the rehabilitant 20.

Figure 1C:
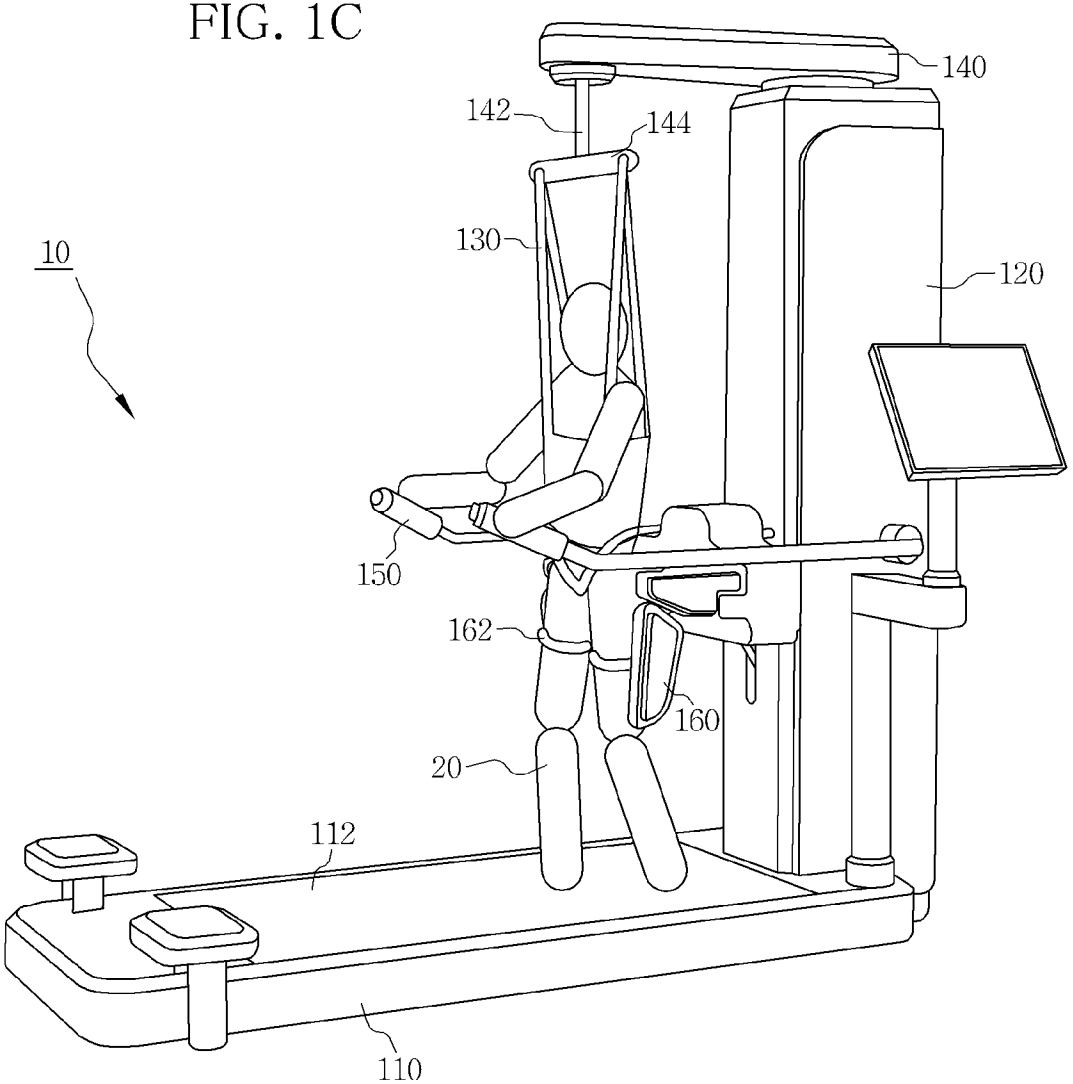

Subsequently, prior to rotation of the rehabilitant 20, the rehabilitant 20 is lifted by decreasing the length of the first connection rod 142, and is then seated on the first frame 110 by rotating the load support unit 140 (S330). After the rehabilitant 20 is seated on the first frame 110, the gait assistance link member 160 is worn on each leg and pelvis of the rehabilitant 20 by being rotated downwards, and then the safety bar 150 is rotated downwards so that the rehabilitant 20 holds the safety bar with the hand (S340). This state is shown in FIG. 1C. As described above, the sensor detects the connection state between the connection string 130 and the rehabilitant 20 and the state in which the rehabilitant 20 is seated on the first frame 110. The information detected by the sensor is transferred to the control portion, thereby enabling the control portion to control the positions of the load support unit 140 and the safety bar 150.

Figure 1D:
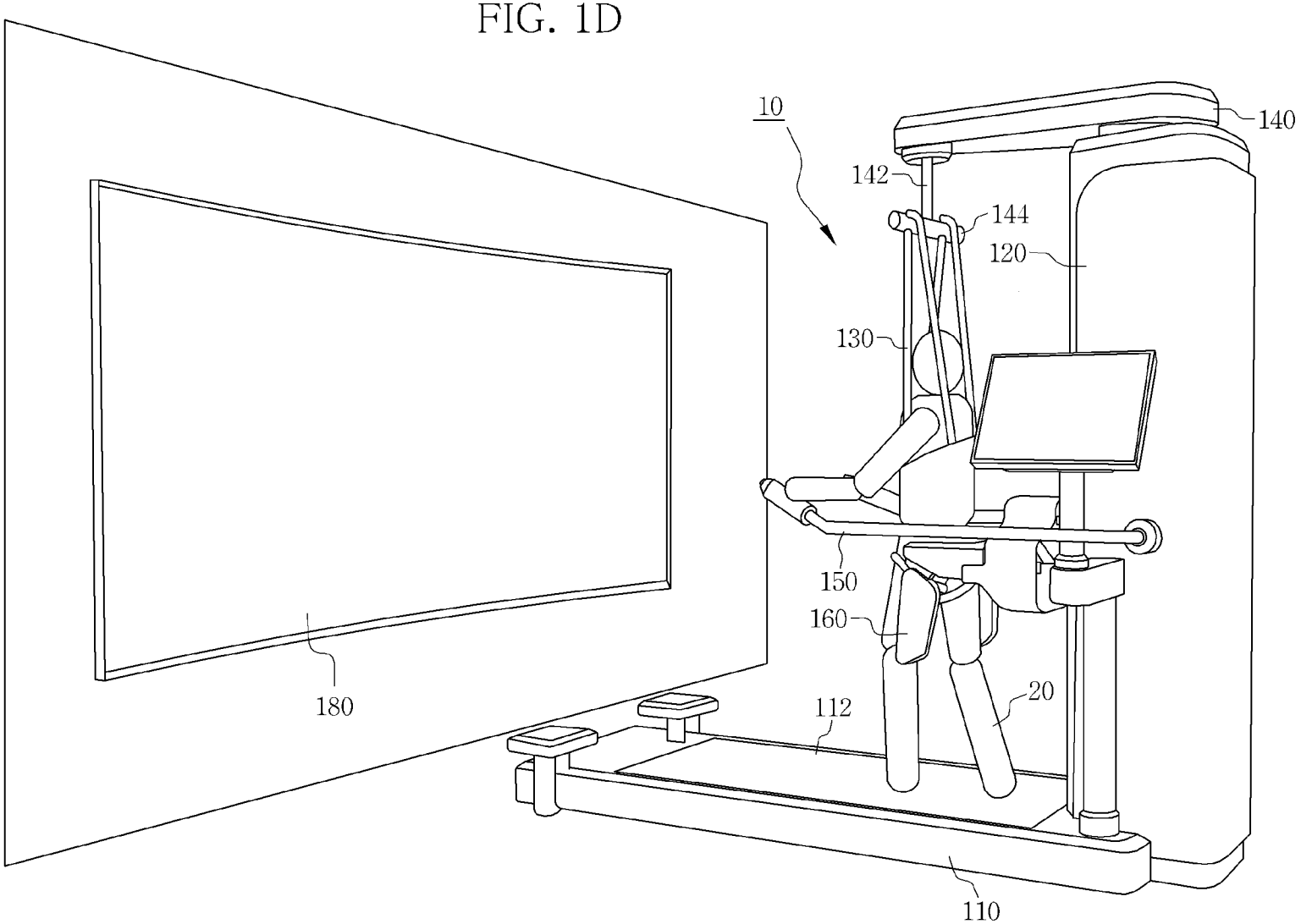

Thereinafter, as shown in FIG. 1D, the rehabilitant may conduct the rehabilitation training while visually identifying a gait environment through a screen 180 (S350).

In accordance with the present invention, since the rehabilitant 20 enters from the side of the gait rehabilitation apparatus 10 by the load support unit 140, it may be possible to enhance space efficiency and to notably reduce a risk of a safety accident.

As is apparent from the above description, in a gait rehabilitation apparatus having a lateral entry mechanism and a lateral entry method using the same according to the present invention, since a rehabilitant laterally enters the gait rehabilitation apparatus, it may be possible to minimize a space required for the entry of the rehabilitant and to decrease a risk of a safety accident during the entry of the rehabilitant for training.

In addition, in the gait rehabilitation apparatus having a lateral entry mechanism and the lateral entry method using the same according to the present invention, since a load support unit rotates after an upper body of the rehabilitant is securely connected to a connection string in a state in which the rehabilitant is placed at the side of the gait rehabilitation apparatus, it may be possible to easily perform work to connect the connection string and to safely perform movement of the rehabilitant.

While the present invention has been described with respect to the specific embodiments, it will be apparent to those skilled in the art that various changes and modifications may be made without departing from the spirit and scope of the invention as defined in the following claims.

What is claimed is:

1. A gait rehabilitation apparatus, comprising:

a first frame comprising a movable bottom surface;

a second frame extending upwards from a tip of the first frame;

a load support unit mounted to an upper end of the second frame and rotatable about an axis of the second frame;

a connection string, wherein one end of the connection string is connected to the load support unit, and the another end of the connection string is adapted to be connected to an upper body of a rehabilitant;

a safety bar connected to the second frame and rotatable so as to be tilted upwards; and gait assistance link members connected to the second frame and capable of tilting upwards, wherein the gait assistance link members are adapted to be connected to each leg of the rehabilitant, wherein the gait assistance link members are located entirely inside a rotation radius defined by an end of the load support unit in a state of the gait assistance link members being tilted upwards.

2. The gait rehabilitation apparatus according to claim 1, wherein the load support unit comprises a rotation drive portion and a control portion configured to perform rotational drive speed and angle control required for lateral entry and gait training.

3. The gait rehabilitation apparatus according to claim 1, wherein the load support unit comprises a first connection rod extending downwards, and a second connection rod integrally formed with the first connection rod and extending in both directions from a tip of the first connection rod.

4. The gait rehabilitation apparatus according to claim 1, further comprising a sensor configured to detect a connection state between the connection string and the rehabilitant and a state in which the rehabilitant is seated on the first frame.

5. The gait rehabilitation apparatus of according to claim 1, wherein the gait assistance link members are connected to the second frame via a four-bar linkage mechanism.

6. The gait rehabilitation apparatus according to claim 1, further comprising a controller configured to control moving speed of the bottom surface, position of the load support unit, position of the safety bar, and movement of the gait assistance link members.

7. The gait rehabilitation apparatus according to claim 1, further comprising a controller configured to adjust moving speed of the bottom surface based on a training intensity setting, and to adjust movement of the gait assistance link members based on the moving speed of the bottom surface.

8. The gait rehabilitation apparatus according to claim 1, further comprising a controller configured to drive a motor to tilt the safety bar upwards, prior to the rehabilitant entering the gait rehabilitation apparatus.

9. The gait rehabilitation apparatus according to claim 8, wherein the controller is further configured to drive the motor to tilt the safety bar to be parallel to the first frame, in response to the rehabilitant entering the gait rehabilitation apparatus.

10. The gait rehabilitation apparatus according to claim 1, wherein the safety bar is located entirely inside the rotation radius defined by the end of the load support unit in a state of the safety bar being tilted upwards.

11. A lateral entry method using a gait rehabilitation apparatus, the method comprising:

providing the gait rehabilitation apparatus, the gait rehabilitation apparatus comprising:

a first frame comprising a movable bottom surface;

a second frame extending upwards from a tip of the first frame;

a load support unit mounted to an upper end of the second frame and rotatable about an axis of the second frame;

a connection string, wherein one end of the connection string is connected to the load support unit, and the another end of the connection strong is adapted to be connected to an upper body of a rehabilitant;

gait assistance link members connected to the second frame and capable of tilting upwards, wherein the gait assistance link members are adapted to be connected to each leg of the rehabilitant, wherein the gait assistance link members are located entirely inside a rotation radius defined by an end of the load support unit in a state of the gait assistance link members being tilted upwards;

connecting the upper body of the rehabilitant, which is placed at a side of the first frame, to the connection string; and seating the rehabilitant on the first frame by rotating the load support unit.

12. The lateral entry method using a gait rehabilitation apparatus according to claim 11, further comprising upwardly tilting the safety bar and upwardly tilting the gait assistance link members, prior to connecting the upper body of the rehabilitant to the connection string.

* * * * *